US011223887B1

(12) United States Patent
Webb et al.

(10) Patent No.: US 11,223,887 B1
(45) Date of Patent: Jan. 11, 2022

(54) SOUND ATTENUATING AUDIO CAPTURE AND TRANSMISSION DEVICE

(71) Applicant: Damon Webb, Victoria (CA)

(72) Inventors: Damon Webb, Victoria (CA); Nigel Kostiuck, Duncan (CA); Andrew Loen, Victoria (CA)

( * ) Notice: Subject to any disclaimer, the term of this patent is extended or adjusted under 35 U.S.C. 154(b) by 0 days.

(21) Appl. No.: 16/995,074

(22) Filed: Aug. 17, 2020

(51) Int. Cl.
*H04R 1/08* (2006.01)
*H04R 1/02* (2006.01)
*H04R 1/10* (2006.01)

(52) U.S. Cl.
CPC ..... *H04R 1/083* (2013.01); *H04R 1/1033* (2013.01); *H04R 1/02* (2013.01); *H04R 2420/07* (2013.01)

(58) Field of Classification Search
CPC ... H04R 1/00; H04R 1/02; H04R 1/04; H04R 1/08; H04R 1/083; H04R 1/086; H04R 1/10; H04R 1/1033; H04R 3/00; H04R 3/02; H04R 2420/07; H04M 1/19; H04M 1/72433; H04M 9/085; G10L 21/007; G10K 11/1787; G10K 11/17861
See application file for complete search history.

(56) References Cited

U.S. PATENT DOCUMENTS 2,745,911 A * 5/1956 Webb ..... H04R 1/083 181/242
3,114,802 A 12/1963 Beguin
3,193,624 A 7/1965 Webb et al.
3,796,842 A * 3/1974 Guille ..... H04R 1/083 381/367
4,129,754 A 12/1978 Gore
4,834,212 A * 5/1989 Figone ..... G10K 11/16 181/175
6,121,881 A 9/2000 Bieback et al.
7,783,034 B2 * 8/2010 Manne ..... H04M 1/19 379/441
8,243,944 B2 8/2012 Almagro
D766,202 S 9/2016 Webb et al.
(Continued)

FOREIGN PATENT DOCUMENTS

WO WO2019236046 12/2019

*Primary Examiner* — Thang V Tran
(74) *Attorney, Agent, or Firm* — Baumgartner Patent Law; Marc Baumgartner

(57) ABSTRACT

An audio capture and transmission device for simultaneously communicating with a wireless communication device and a wired communication device is provided, the audio capture and transmission device for fitting generally over a user's mouth, the audio capture and transmission device comprising: an inner housing, the inner housing including a distal end, an air tube extending inward and outward therefrom, a proximal end and walls therebetween to define a cavity and a gutter on an outer surface; a gasket seated in the gutter; a form-fitting face piece located proximally on the inner housing, the form-fitting face piece defining a proximal opening continuous with the cavity; an outer housing, the outer housing, the gasket and the inner housing defining an interior, the outer housing including a distal end, the distal end including a plurality of apertures and an exhaust port, the exhaust port aligned with the air tube and in gaseous communication with the air tube; a microphone which is housed within the cavity; and electronics which are housed in the interior and include a wireless radio, a headphone jack and circuitry.

16 Claims, 7 Drawing Sheets

(56) References Cited

U.S. PATENT DOCUMENTS

| | | | | |
|---|---|---|---|---|
| D766,203 | S | 9/2016 | Webb | |
| 9,912,819 | B2 | 3/2018 | Webb et al. | |
| 2008/0195390 | A1 | 8/2008 | Almargro | |
| 2020/0128310 | A1* | 4/2020 | Umhoefer | H04R 1/10 |
| 2021/0258414 | A1* | 8/2021 | Nesterenko | H04M 1/19 |

* cited by examiner

SOUND ATTENUATING AUDIO CAPTURE AND TRANSMISSION DEVICE

FIELD

The present technology relates to a wireless, small, ergonomically designed, voice transmitting and attenuating device for fitting over a user's mouth. The device contains a microphone and a radio for transmitting a user's voice to an electronic device. The structural design minimizes the escape of any sound from the device to the outside environment and reduces or minimizes the amount of ambient sound that reaches the microphone, thereby providing very clear, high fidelity voice transmission which can then be heard, transcribed or recorded.

BACKGROUND

Various devices have been developed for damping and recording voice sound waves. For example, U.S. Pat. No. 3,114,802 discloses an early design that essentially provides a cup-like structure for fitting over the user's mouth, with a microphone housed therein.

Similar devices have been used by court reporters. One such acoustic mask is disclosed in U.S. Pat. No. 3,193,624. This device has a cylindrical outer casing and a separate wall structure housed within the casing with a microphone mounted on this structure. The device includes a cylindrical air inhalation passageway extending outward from the face-masking structure for inhalation, with a diaphragm to restrict expulsion of air. One or more openings in the face-masking structure allow for exhaled air and sound to escape. The face-fitting part of the device is rubber and must be pressed to the user's face in order to reduce the amount of sound escaping to the ambient. The device is not designed to reduce leakage of ambient sound into the device, nor is it ergonomically designed. Further, there is no means for the user to hear the sound that they are producing in the device.

Another acoustic mask is disclosed in U.S. Pat. No. 4,129,754. The device includes a barrel with a bell-shaped back, the latter preferably being set at an angle with respect to the barrel. A microphone is positioned at the end of the barrel remote from the bell-shaped back. The barrel portion and a portion of the bell-shaped back are lined with foam urethane to muffle noise and absorb moisture. The reporting device includes orifices located at the junction between the bell-shaped back (face piece) and the barrel for permitting pressurized air within the device to escape to the outside via an air communication channel from inside the device to the outside. Again, the face piece is a soft pliable material that requires it be pressed against the user's face in order to reduce escape of the user's voice from within the device. Further, there is no means for the user to hear the sound that they are producing in the device.

In a related technology, U.S. Pat. No. 6,121,881 discloses a protective mask communication device including a housing constructed to be mounted on a protective mask. A microphone is located within the housing. The mask is contemplated to be a safety mask, such as that worn by firefighters. No attempts are made to restrict escape of sound into the ambient atmosphere or reduce ambient sound.

U.S. Pat. No. 8,243,944 discloses a handheld foldable voice-muffling device using passive noise damping materials to decrease noise and a single microphonic transceiver to transmit a user's speech and receive incoming signals allowing him to wirelessly communicate with another person or other communication devices. The deformable materials used in the device do not adequately muffle the sound of the user nor ambient sound. Further, the device must be pressed to the user's face in order for the deformable material to form to the user's face. This is uncomfortable for the user, but is necessary to reduce the escape of sound between the face piece and the user's face. The device is not designed to record sound with the microphone and transmit the sound simultaneously to each of an ear piece and a phone. This makes communication difficult as the user is not experiencing the normal sounds that one experiences during a conversation.

United States Patent Application Publication No. 20080195390 discloses a wireless voice muffled device for cellular or mobile phones and voice recognition systems that substantially reduces vocal noise, extra portability and clear intelligible output, said device comprising: a microphone, a transceiver and sound absorbing means. It has three adaptations: handheld, handheld foldable, hands-free and palm-held. The device is not designed to record sound with the microphone and transmit the sound simultaneously to each of an ear piece and a phone. This makes communication difficult as the user is not experiencing the normal sounds that one experiences during a conversation.

WO2019236046 discloses a wireless confidential device for voice communication comprising an ergonomically shaped housing (1) with a flange (2), the shape of which for covering the area around the user's mouth. The housing (1) comprises at least one microphone (3), transceiver, switch (4), sound absorbing means or a sound reducing means (5), includes a front portion (6), side portions (7) and back portion (8). The flange (2) is located on the inner surface of the front part (6) of the housing (1), the device includes a wired or wireless headset (9), at least one headphone (10) connected with the mobile communication means, and arranged to complement the passive muffling methods of speech by active muffling methods of speech and noise reduction technique. This is an overly complex system that is bulky and unwieldy. It cannot be easily carried and held by a user.

U.S. Pat. No. 9,912,819 discloses a device for simultaneously communicating with a first wireless communication device and a second wireless communication device. A microphone is housed within the device and circuitry therefor is included in the device, and preferably housed within the device. The device form-fits generally over a user's mouth and nose and has an air tube extending substantially the length of the device, within the interior of the device, to relieve back-pressure. The device is shaped to promote attenuation of sound within the device, and is constructed to reduce uptake of outside, extraneous sound by the microphone. The circuitry comprises one or more processors, an audio capture module, power management module, listening output module, and data storage module. The device also has a touch screen interface.

There is a need for a small voice attenuating device that provides very clear, high fidelity voice transmission simultaneously to both the user, by means of an ear piece, and to a wireless communication device such as a cell phone. Such a device would preferably overcome the challenges of recording or transmitting a user's voice while attenuating the sound of the user's voice. It would also preferably cancel or reduce ambient noise without the need for noise canceling microphones.

SUMMARY

The present technology provides a small device for fitting generally over a user's mouth to provide very clear, high fidelity voice transmission. It functions as an intermediary between a cellular phone and an electronic device.

In one embodiment, an audio capture and transmission device for use with a power source is provided, for simultaneously communicating with a wireless communication device and a wired communication device, the audio capture and transmission device for fitting generally over a user's mouth, the audio capture and transmission device comprising: an inner housing, the inner housing including a distal end, an air tube extending inward and outward therefrom, a proximal end and walls therebetween to define a cavity and a gutter on an outer surface; a gasket seated in the gutter; a form-fitting face piece located proximally on the inner housing, the form-fitting face piece defining a proximal opening continuous with the cavity; an outer housing, the outer housing, the gasket and the inner housing defining an interior, the outer housing including a distal end, the distal end including a plurality of apertures and an exhaust port, the exhaust port aligned with the air tube and in gaseous communication with the air tube; a microphone housed within the cavity; and electronics which are housed in the interior and include a wireless radio, a headphone jack and circuitry.

In the device, the microphone may be located about 15 to about 35 mm from the proximal end of the inner housing.

In the device, the form-fitting face piece may include a resilient lip which is slidably and releasably retained by the proximal end of the inner housing.

In the device, the form-fitting face piece may include a proximally located cushioned pad.

In the device, the inner housing may include a flared flume on an inner surface which extends substantially the length of the inner housing, terminating at the air tube and continuous with the air tube.

In the device, the wireless radio may be a Bluetooth radio.

In another embodiment, an audio capture and transmission system for simultaneously communicating with a wireless communication device and a least one earpiece or earphone is provided, the system comprising the device as described above and the at least one headphone, the at least one headphone plugged into the headphone jack.

The system may further comprise the wireless communication device.

In the system, the wireless communication device may be a cellular phone.

In another embodiment, a method of simultaneously communicating to a wireless communication device and a wired communication device is provided, the method comprising placing the device as described above generally over the user's mouth and the user speaking into the device.

In the method, the wireless communication device may be a cellular phone and the wired communication device may be an earpiece or earphone.

FIGURES

DESCRIPTION

Figure 1:
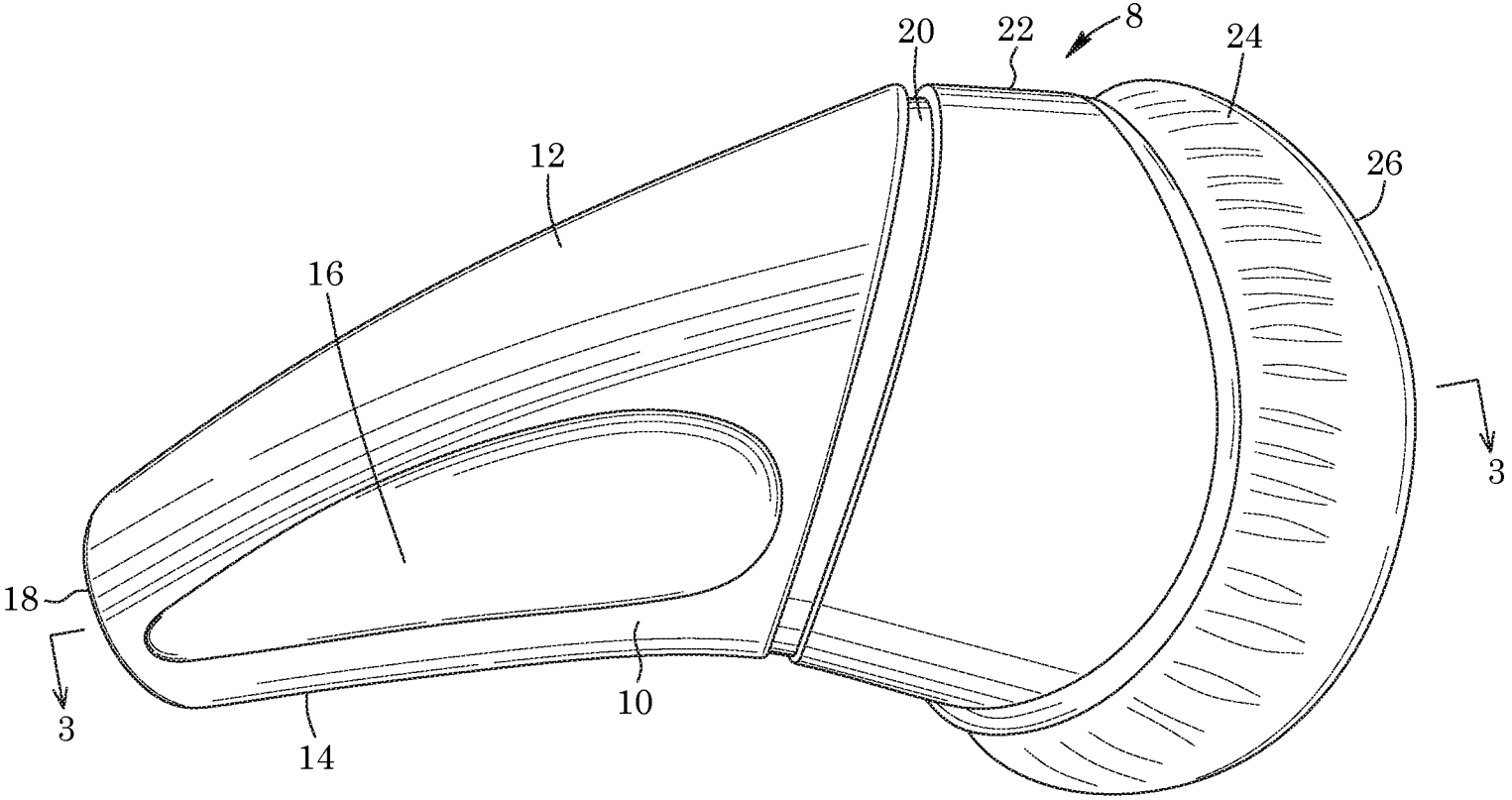
FIG. 1 is a side view of the audio capture and transmission device of the present technology.

Except as otherwise expressly provided, the following rules of interpretation apply to this specification: (a) all words used herein shall be construed to be of such gender or number (singular or plural) as the circumstances require; (b) the singular terms "a", "an", and "the", as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein", "hereby", "hereof", "hereto", "hereinbefore", and "hereinafter", and words of similar import, refer to this specification in its entirety and not to any particular paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms "comprising," "having," "including," and "containing" are to be construed as open-ended terms (i.e., meaning "including, but not limited to,") unless otherwise noted.

Recitation of ranges of values herein are merely intended to serve as a shorthand method of referring individually to each separate value falling within the range, unless otherwise indicated herein, and each separate value is incorporated into the specification as if it were individually recited herein. Where a specific range of values is provided, it is understood that each intervening value, to the tenth of the unit of the lower limit unless the context clearly dictates otherwise, between the upper and lower limit of that range and any other stated or intervening value in that stated range, is included therein. All smaller sub ranges are also included. The upper and lower limits of these smaller ranges are also included therein, subject to any specifically excluded limit in the stated range.

Unless defined otherwise, all technical and scientific terms used herein have the same meaning as commonly understood by one of ordinary skill in the relevant art. Although any methods and materials similar or equivalent to those described herein can also be used, the acceptable methods and materials are now described.

Definitions

In the context of the present technology, the term "fitting generally over a user's mouth" means that the user's mouth is covered, such that their voice is projected into the interior cavity of the device.

In the context of the present technology, the wireless radio may be a Bluetooth® radio.

In the context of the present technology, a phone call or call is any sort of verbal communication over a wired or a processor controlled Bluetooth enabled communication device, such as, but not limited to a cellular phone, a laptop, a tablet, voice activated apps, recorders, transmitters, landline phones, computers or any device that uses speech and/or a microphone, including a telephone call, a Skype call and the like.

In the context of the present technology, a phone is any sort of processor controlled wired or Bluetooth enabled communication device, such as, but not limited to a cellular phone, a laptop, or a tablet computer, voice activated apps, recorders, transmitters, landline phones, computers or any device that uses speech and/or a microphone.

In the context of the present technology, a wireless communication device is any sort of processor controlled wireless or Bluetooth enabled communication device, such as, but not limited to a cellular phone, a laptop, or a tablet computer, voice activated apps, recorders, transmitters, computers or any device that uses speech and/or a microphone.

In the context of the present technology, a headphone may be a pair of ear buds, a single earbud, a pair of headphones, a single headphone, an earpiece, an earphone and the like.

DETAILED DESCRIPTION

An audio capture and transmission device, generally referred to as 8 is shown in FIG. 1. An outer housing 10 has an angled, curved back 12, a generally planar base 14 and two side 16 extending therebetween to create a wedge shape terminating in a distal end 18. A gasket 20 extends around an outer rim 22 and is between the outer rim 22 and the outer housing 10. A face piece 24 is mounted on the proximal end 26 of the outer rim 22. The outer housing 10 has an ergonomic shape to fit either hand.

Figure 2:
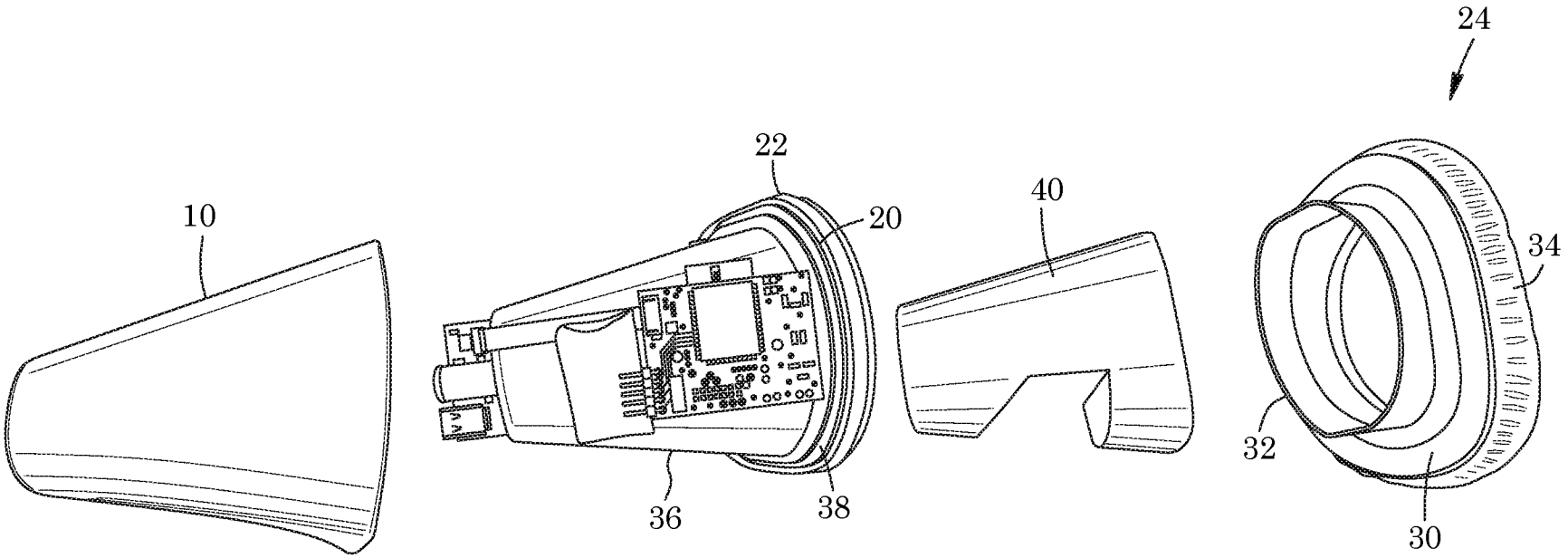
FIG. 2 is an exploded view of the device of FIG. 1.

As shown in FIG. 2, the face piece 24 includes a resilient plastic polymer oval ring 30 which has a resilient lip 32 that fits into the outer rim 22 and a soft cushioned pad 34 for form-fitting over a user's mouth. The outer rim 22 is attached to or is continuous with an inner housing 36 and forms a groove 38 into which the gasket 20 is seated. The gasket 20 separates the inner housing 36 from the outer housing 10. A sound damping foam core 40 is housed in the inner housing 36 and substantially fills the cavity 44 (See FIG. 3 for the cavity).

Figure 3:
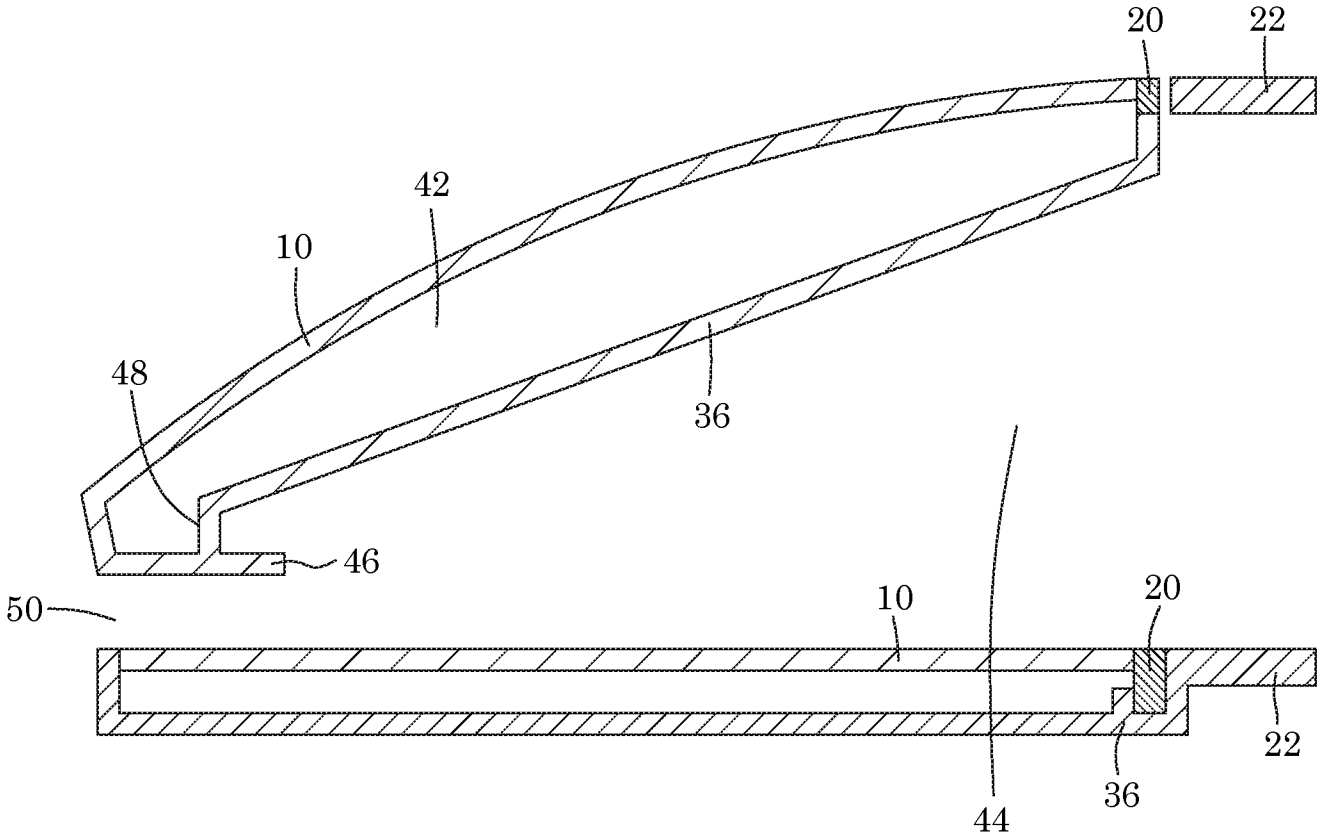
FIG. 3 is a longitudinal sectional view along line 3-3 of FIG. 1.

As shown in FIG. 3, the outer housing 10 and the inner housing 36 (and the gasket 20) define an interior 42 in which the electronics are housed. The inner housing 36 and the outer rim 22 define a cavity 44. A short air tube 46 extends outward and inward from the distal end 48 of the inner housing 36 and abuts the outer housing 10, aligning with an exhaust port 50.

The interior 42 protects the electronics from the ambient and from any moisture that might build up within the cavity 44. The interior 42 also provides additional sound damping.

Figure 4:
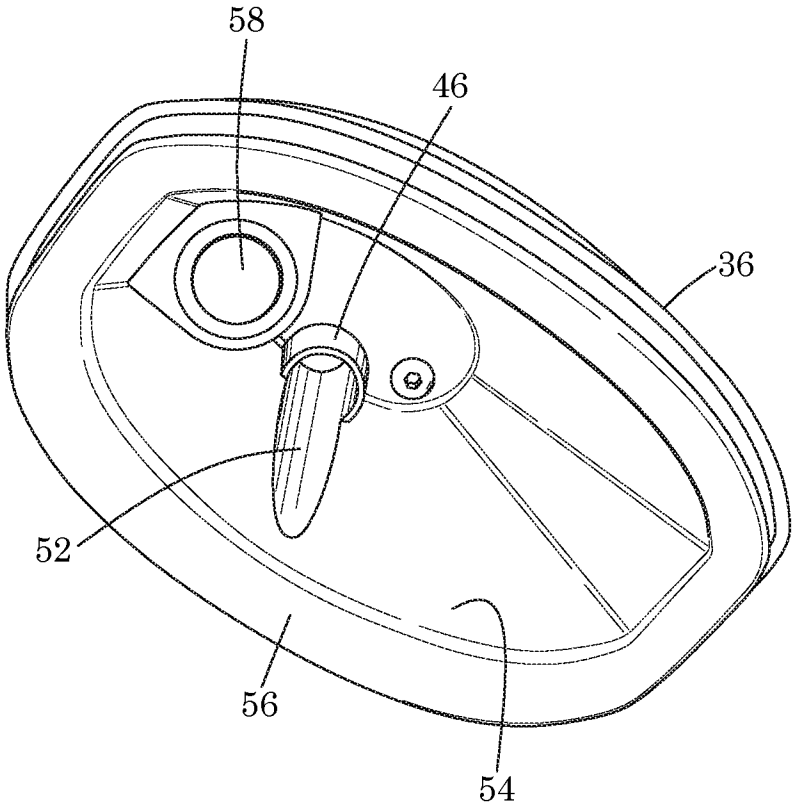
FIG. 4 is a proximal end view of the device of FIG. 1.

As shown in FIG. 4, a flared flume 52 is continuous with the short air tube 46 and extends substantially the length of the inner surface 54 of the inner housing 36, with the point of the flared flume 52 located proximate the proximal end 56 of the inner housing 36. The inner surface 54 of the inner housing 36 is shaped to encourage reflection of sound waves and is an oblong frustro-cone shape. A microphone 58 is housed in the inner housing 36, proximate the proximal end 56. The microphone is preferably 15 mm to 35 mm from the proximal end 56 of the inner housing 36.

Figure 5:
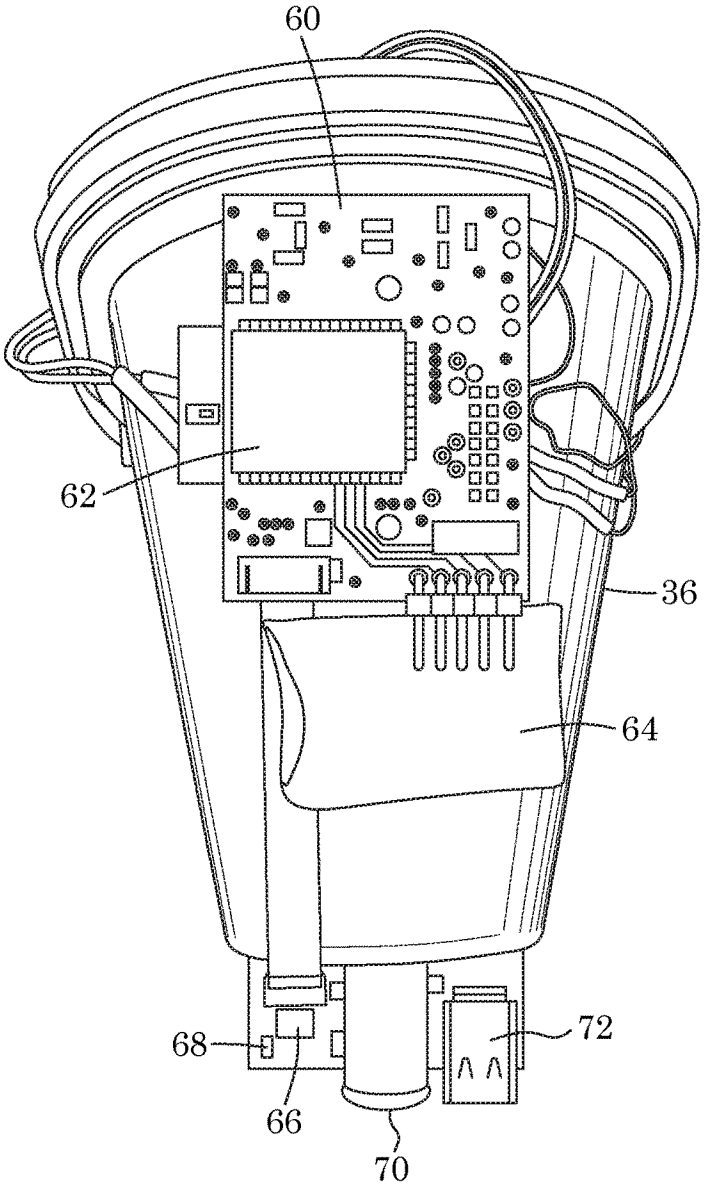
FIG. 5 is a top view of the inner housing of the device of FIG. 1.

As shown in FIG. 5, a circuit board 60, a wireless radio 62, a battery 64, a power switch 66, a light emitting diode (LED) indicator light 68, a headphone jack 70 and a charging port 72 are mounted on the inner housing 36.

Figure 6:
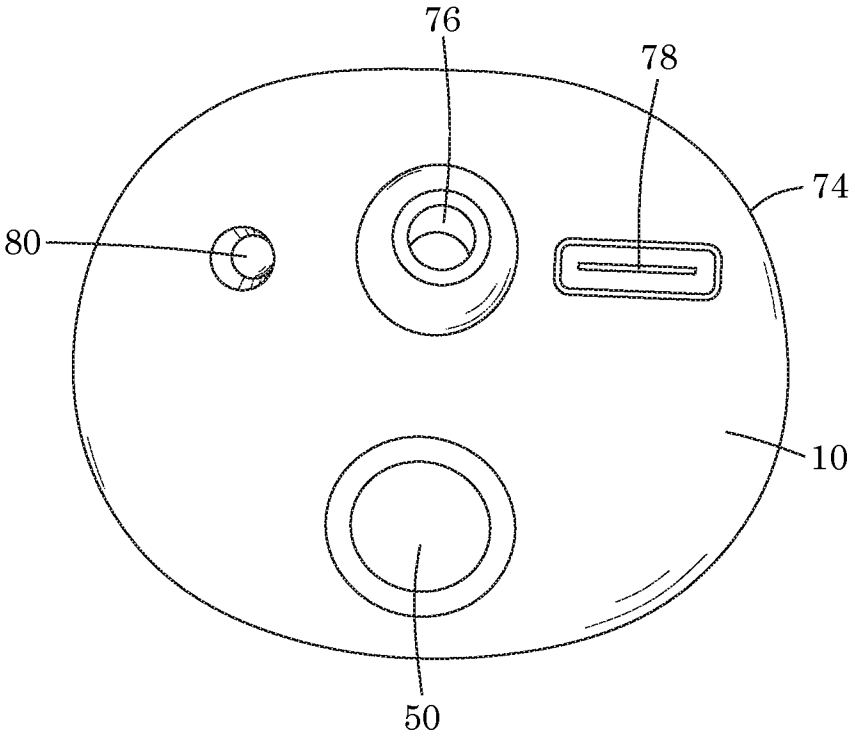
FIG. 6 is a distal end view of the device of FIG. 1.

As shown in FIG. 6, the distal end 74 of the outer housing 10 has a headphone jack aperture 76, a charging port aperture 78, the exhaust port 50 and a combined power switch-LED indicator light aperture 80.

Figure 7:
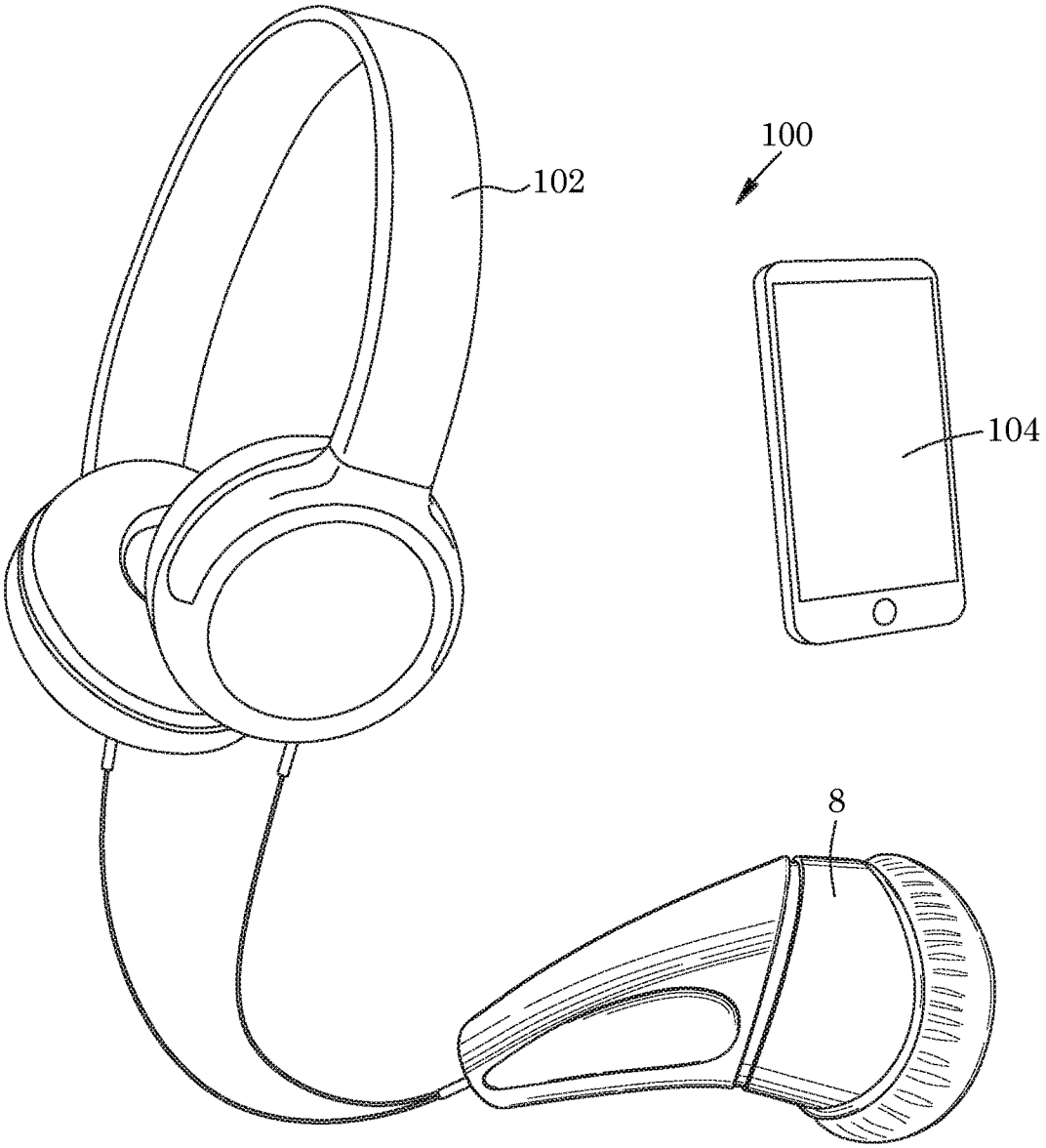
FIG. 7 is a schematic of the system of the present technology.

A system for attenuating sound while capturing and transmitting speech, generally referred to as 100 is shown in FIG. 7. One earpiece or earphone or a pair of headphones 102 are attached to the device 8 via the headphone jack 70. An electronic device, for example a cell phone 104 is in wireless communication with the device 8.

In use, a user presses the device 8 around their mouth with the soft cushioned pad abutting their chin, upper lip and cheeks. The user then speaks. Sound is transmitted from the user into the cavity 44 where it is picked up by the microphone 58 and sent, via the wireless radio 62 to the electronic device 104 and incoming sound from the electronic device 104 is picked up via the wireless radio 62 and simultaneously sent, via the headphone jack 70 to the headphones 102. Ambient sound is damped, and sound transmitted from the user is attenuated. Sound emanating from the electronic device 104 is transmitted via the wireless radio 62 and incoming sound to the headphone jack 70 to the headphones 102.

While the technology has been described in detail, such a description is to be considered as exemplary and not restrictive in character and is to be understood that it is the presently preferred embodiments of the present technology and is thus representative of the subject matter which is broadly contemplated by the present technology, and that all changes and modifications that come within the spirit of the disclosure are desired to be protected.

The invention claimed is:

1. An audio capture and transmission device for use with a power source, for simultaneously communicating with a wireless communication device and a wired communication device, the audio capture and transmission device for fitting generally over a user's mouth, the audio capture and transmission device comprising: an inner housing, the inner housing including a distal end, an air tube extending inward and outward therefrom, a proximal end and walls therebetween to define a cavity and a gutter on an outer surface; a gasket seated in the gutter; a form-fitting face piece located proximally on the inner housing, the form-fitting face piece defining a proximal opening continuous with the cavity; an outer housing, the outer housing, the gasket and the inner housing defining an interior, the outer housing including a distal end, the distal end including a plurality of apertures and an exhaust port, the exhaust port aligned with the air tube and in gaseous communication with the air tube; a microphone housed within the cavity; and electronics which are housed in the interior and include a wireless radio, a headphone jack and circuitry.

2. The device of claim 1, wherein the microphone is located about 15 to about 35 mm from the proximal end of the inner housing.

3. The device of claim 1, wherein the form-fitting face piece includes a resilient lip which is slidably and releasably retained by the proximal end of the inner housing.

4. The device of claim 3, wherein the form-fitting face piece includes a proximally located cushioned pad.

5. The device of claim 1, wherein the inner housing includes a flared flume on an inner surface which extends substantially the length of the inner housing, terminating at the air tube and continuous with the air tube.

6. The device of claim 5, wherein the wireless radio is a Bluetooth radio.

7. An audio capture and transmission system for simultaneously communicating with a wireless communication device and a least one earpiece or earphone, the system comprising the device of claim 1 and the at least one headphone, the at least one headphone plugged into the headphone jack.

8. The system of claim 7, further comprising the wireless communication device.

9. The system of claim 8, wherein the wireless communication device is a cellular phone.

10. An audio capture and transmission system for simultaneously communicating with a wireless communication device and a least one earpiece or earphone, the system comprising the device of claim 6 and the at least one headphone, the at least one headphone plugged into the headphone jack.

11. The system of claim 10, further comprising the wireless communication device.

12. The system of claim 11, wherein the wireless communication device is a cellular phone.

13. A method of simultaneously communicating to a wireless communication device and a wired communication device, the method comprising: placing the device of claim 1 generally over the user's mouth and the user speaking into the device of claim 1; picking up sound from the user by the microphone; and transmitting the sound by the wireless radio.

14. The method of claim 13, wherein the wireless communication device is a cellular phone and the wired communication device is an earpiece or earphone.

15. A method of simultaneously communicating to a wireless communication device and a wired communication device, the method comprising: placing the device of claim 6 generally over the user's mouth and the user speaking into the device of claim 6; picking up sound from the user by the microphone; and transmitting the sound by the wireless radio.

16. The method of claim 15, wherein the wireless communication device is a cellular phone and the wired communication device is an earpiece or earphone.

* * * * *